US010385859B2

(12) United States Patent
Roussel et al.

(10) Patent No.: US 10,385,859 B2
(45) Date of Patent: Aug. 20, 2019

(54) IN-LINE PRESSURE BOOSTING SYSTEM AND METHOD

(71) Applicant: Franklin Electric Co., Inc., Fort Wayne, IN (US)

(72) Inventors: Jeff Roussel, Little Rock, AR (US); James J. Volk, Fort Wayne, IN (US)

(73) Assignee: Franklin Electric Company, Inc., Fort Wayne, IN (US)

( * ) Notice: Subject to any disclaimer, the term of this patent is extended or adjusted under 35 U.S.C. 154(b) by 96 days.

(21) Appl. No.: 14/101,477

(22) Filed: Dec. 10, 2013

(65) Prior Publication Data

US 2015/0159657 A1 Jun. 11, 2015

(51) Int. Cl.
*F04D 15/02* (2006.01)
*F04D 29/60* (2006.01)
(Continued)

(52) U.S. Cl.
CPC ..... *F04D 15/0209* (2013.01); *F04D 13/086* (2013.01); *F04D 27/004* (2013.01); *F04D 29/605* (2013.01)

(58) Field of Classification Search
CPC ..... F04B 1/08; F04B 49/022; F04B 49/08; F04B 2205/01; F04B 2205/05; F04B 2205/09; F04B 49/065; F04B 49/002; F04B 49/06; F04B 2203/0201; F04B 2203/0208; F04B 2203/0209; F04B 2205/04; F04B 23/021; F04B 43/0054; F04B 43/026; F04B 43/04; F04B 49/24; F04D 9/008; F04D 27/004; F04D 29/605; F04D 29/606; F04D 13/086; F04D 15/0066; F04D 15/0077; F04D 15/0209; F04D 15/0218; F04D 13/06; F04D 13/10; F04D 13/16; F04D 15/0005; F04D 15/0011; F04D 29/48; H01H 35/405; H01H 35/34; H01H 9/08;
(Continued)

(56) References Cited

U.S. PATENT DOCUMENTS 4,124,331 A 11/1978 Taki
5,259,733 A 11/1993 Gigliotti et al.
(Continued)

FOREIGN PATENT DOCUMENTS

SU 515094 5/1976

OTHER PUBLICATIONS

McDonald, "23000 Series 4" Stainless Steel Submersible Pumps, Jun. 2013.

(Continued)

*Primary Examiner* — Charles G Freay
(74) *Attorney, Agent, or Firm* — Faegre Baker Daniels LLP

(57) ABSTRACT

A pressure boosting system and a method of using the same to increase fluid pressure in a fluid distribution system are disclosed. The pressure boosting system may be installed "in-line" with the fluid distribution system. The pressure boosting system includes a submersible pump and a controller that may be configured to control the submersible pump based on an outlet pressure if inlet pressure is below a threshold. The pressure boosting system may also control the submersible pump based on a flow of the fluid through a pump unit as a function of the inlet pressure. A mounting bracket may be moveably coupled to a tank of the pressure boosting system.

7 Claims, 16 Drawing Sheets

(51) Int. Cl.
*F04D 27/00* (2006.01)
*F04D 13/08* (2006.01)

(58) Field of Classification Search
CPC ..... Y10T 137/6851; Y10T 137/7737; G05D 16/2066; E03B 7/075; E03B 5/02; E03B 7/072
USPC ..... 417/20, 31, 38, 43, 44.2, 44.3, 301, 360, 417/361, 423.15
See application file for complete search history.

(56) References Cited

U.S. PATENT DOCUMENTS 5,464,327 A 11/1995 Horwitz
5,538,396 A * 7/1996 Meierhoefer ..... F04D 15/0209 417/19
5,738,495 A 4/1998 Carmignani et al.
6,065,946 A * 5/2000 Lathrop ..... F04B 49/065 310/43
6,085,599 A * 7/2000 Feller ..... G01F 1/60 73/861.13
6,273,684 B1 8/2001 Jensen et al.
6,472,624 B1 10/2002 Harris et al.
6,682,309 B2 1/2004 Reid
7,083,392 B2 8/2006 Meza et al.
7,105,757 B2 9/2006 Valentini
8,313,305 B2 11/2012 Bevington
8,920,131 B2 * 12/2014 Aspen ..... F04B 49/065 417/12
2003/0017055 A1 * 1/2003 Fong ..... F04B 49/022 417/44.9
2005/0123408 A1 * 6/2005 Koehl ..... F04D 15/0088 417/53
2006/0251531 A1 * 11/2006 Favella ..... F04B 23/021 417/423.3
2008/0128464 A1 * 6/2008 Gale ..... B60R 11/00 224/570
2011/0308641 A1 * 12/2011 Hu ..... F24D 3/10 137/468
2012/0148419 A1 * 6/2012 Aspen ..... F04B 49/065 417/53

OTHER PUBLICATIONS

Kelco Engineering Pty Ltd., "Installation and Operation Instructions for the UB Series in Line Flow Switch", at least as early as Nov. 8, 2013.
Grundfos Product Guide, "Domestic Water Supply", at least as early as Oct. 17, 2013.

* cited by examiner

IN-LINE PRESSURE BOOSTING SYSTEM AND METHOD

FIELD OF THE DISCLOSURE

The present disclosure relates to a pressure boosting system for use in a fluid distribution system. More particularly, the present disclosure relates to an in-line pressure boosting system, and to a method of using the same to increase fluid pressure in the fluid distribution system.

BACKGROUND OF THE DISCLOSURE

A fluid distribution system, such as a residential or commercial fluid distribution system, may experience pressure drops. When running a shower or a garden hose in the residential context, for example, the pressure in the fluid distribution system may drop. Over time, a dripping faucet may also cause the pressure in the fluid distribution system to drop.

Conventional systems for boosting pressure in fluid distribution systems suffer from various drawbacks. For example, conventional systems are noisy, difficult to cool, and difficult to install.

SUMMARY

The present disclosure provides a pressure boosting system, and a method of using the same to increase fluid pressure in a fluid distribution system. The pressure boosting system may be installed "in-line" with the fluid distribution system. Also, the pressure boosting system may operate quietly and efficiently.

According to an embodiment of the present disclosure, a pump unit is provided to pressurize a fluid in a fluid delivery system, the pump unit including a tank that forms at least a portion of a fluid reservoir, a fluid inlet into the fluid reservoir, a fluid outlet from the fluid reservoir, a submersible pump positioned in the tank and arranged in fluid communication with the fluid inlet and the fluid outlet, a controller communicatively coupled to the submersible pump, an inlet pressure sensor communicatively coupled to the controller, the inlet pressure sensor configured to sense an inlet pressure of the fluid upstream of the submersible pump and to communicate the inlet pressure of the fluid to the controller, and at least one of an outlet pressure sensor communicatively coupled to the controller, the outlet pressure sensor configured to sense an outlet pressure of the fluid downstream of the submersible pump and to communicate the outlet pressure of the fluid to the controller, and a flow sensor assembly communicatively coupled to the controller, the flow sensor assembly configured to sense a flow of the fluid through the pump unit and to communicate the flow of the fluid to the controller.

According to another embodiment of the present disclosure, a pump unit is provided to pressurize a fluid in a fluid delivery system, the pump unit including a tank that forms at least a portion of a fluid reservoir, a fluid inlet into the fluid reservoir, a fluid outlet from the fluid reservoir, a submersible pump positioned in the tank and arranged in fluid communication with the fluid inlet and the fluid outlet, and a mounting bracket moveably coupled to the tank relative to the fluid inlet and the fluid outlet.

According to yet another embodiment of the present disclosure, a method is provided for controlling a pump unit having a tank that forms at least a portion of a fluid reservoir and a submersible pump positioned in the tank. The method includes the steps of: sensing an inlet pressure of the fluid in the fluid reservoir upstream of the submersible pump; sensing at least one of an outlet pressure of the fluid in the fluid reservoir downstream of the submersible pump and a flow of the fluid through the fluid reservoir; and controlling the submersible pump based on the inlet pressure and at least one of the outlet pressure and the flow.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
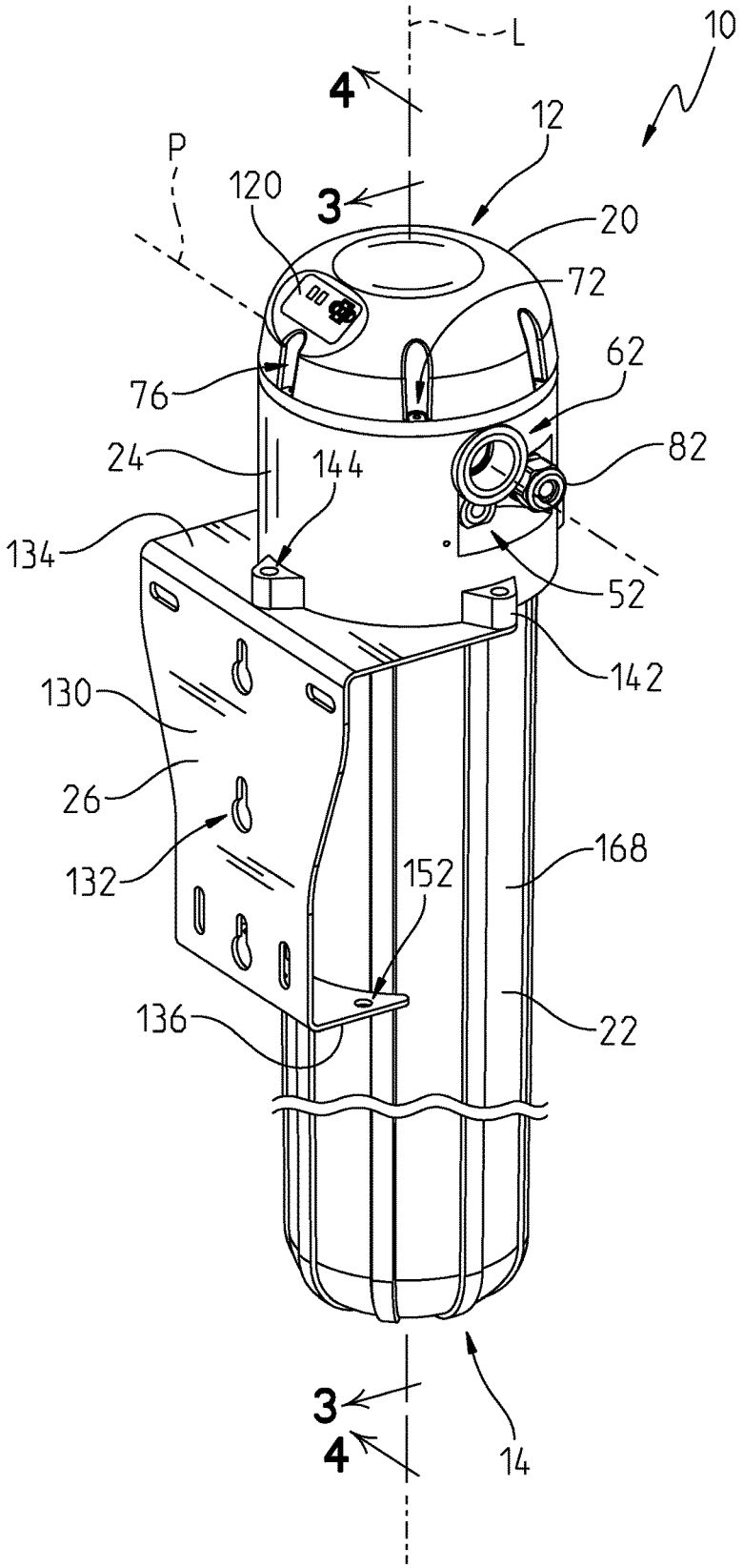
FIG. 1 is an assembled perspective view of an exemplary pump unit of the present disclosure, the pump unit including a cap, a head, a tank, and a mounting bracket.

Referring initially to FIG. 1, a pump unit 10 is provided to increase or boost the fluid pressure in a fluid distribution system. Pump unit 10 is generally cylindrical in shape and has a first end 12 (illustratively a top end in FIG. 1) and a second end 14 (illustratively a bottom end in FIG. 1) arranged along a longitudinal axis L. Pump unit 10 includes a cap 20 positioned at first end 12, an elongate tank 22 positioned at second end 14, and a head 24 positioned therebetween. Cap 20, tank 22, and head 24 may be constructed of plastic or other suitable materials. Pump unit 10 further includes a base or mounting bracket 26 for coupling pump unit 10 to a support structure, as described further below.

Figure 2:
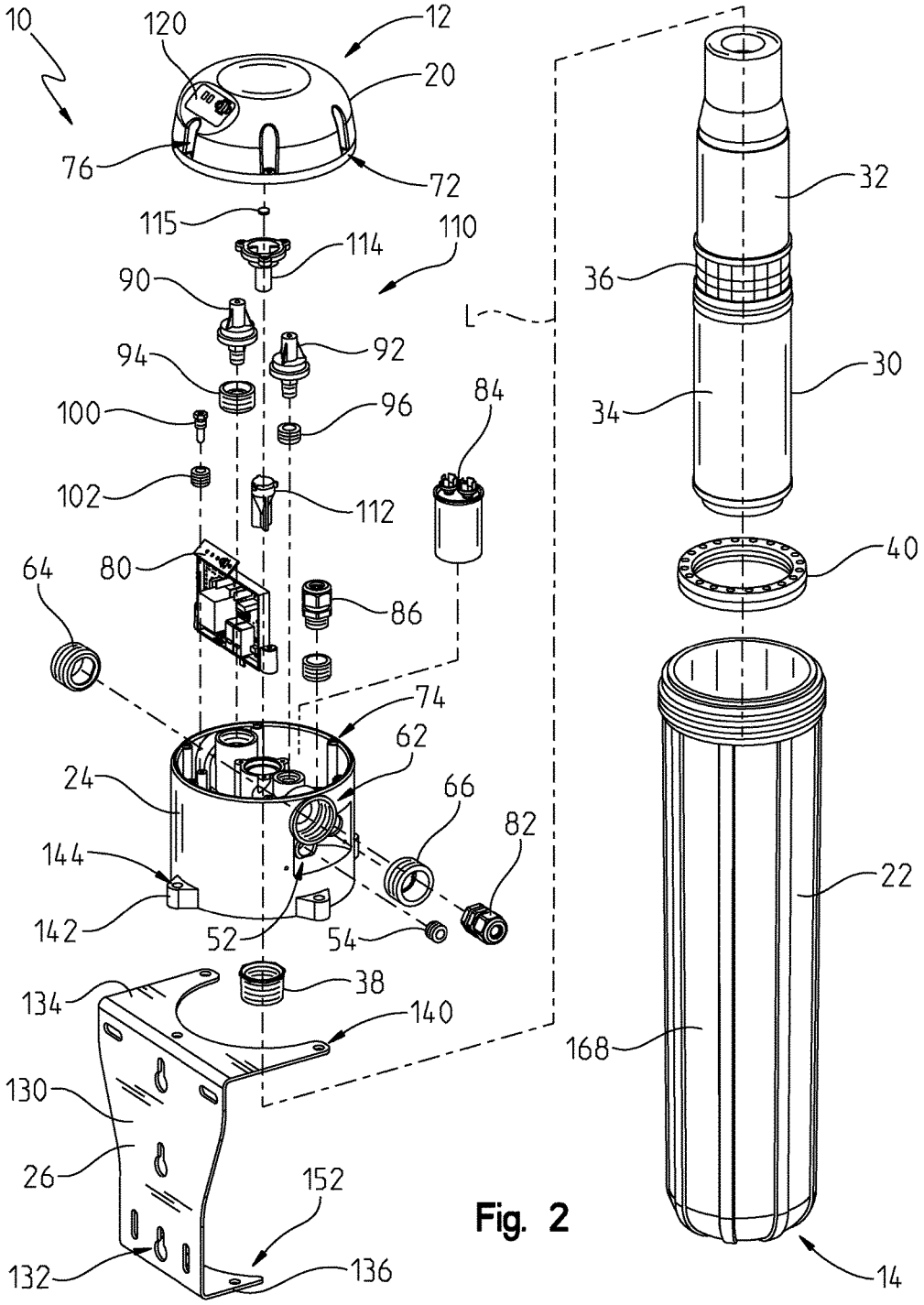
FIG. 2 is an exploded perspective view of the pump unit of FIG. 1.
Figure 3:
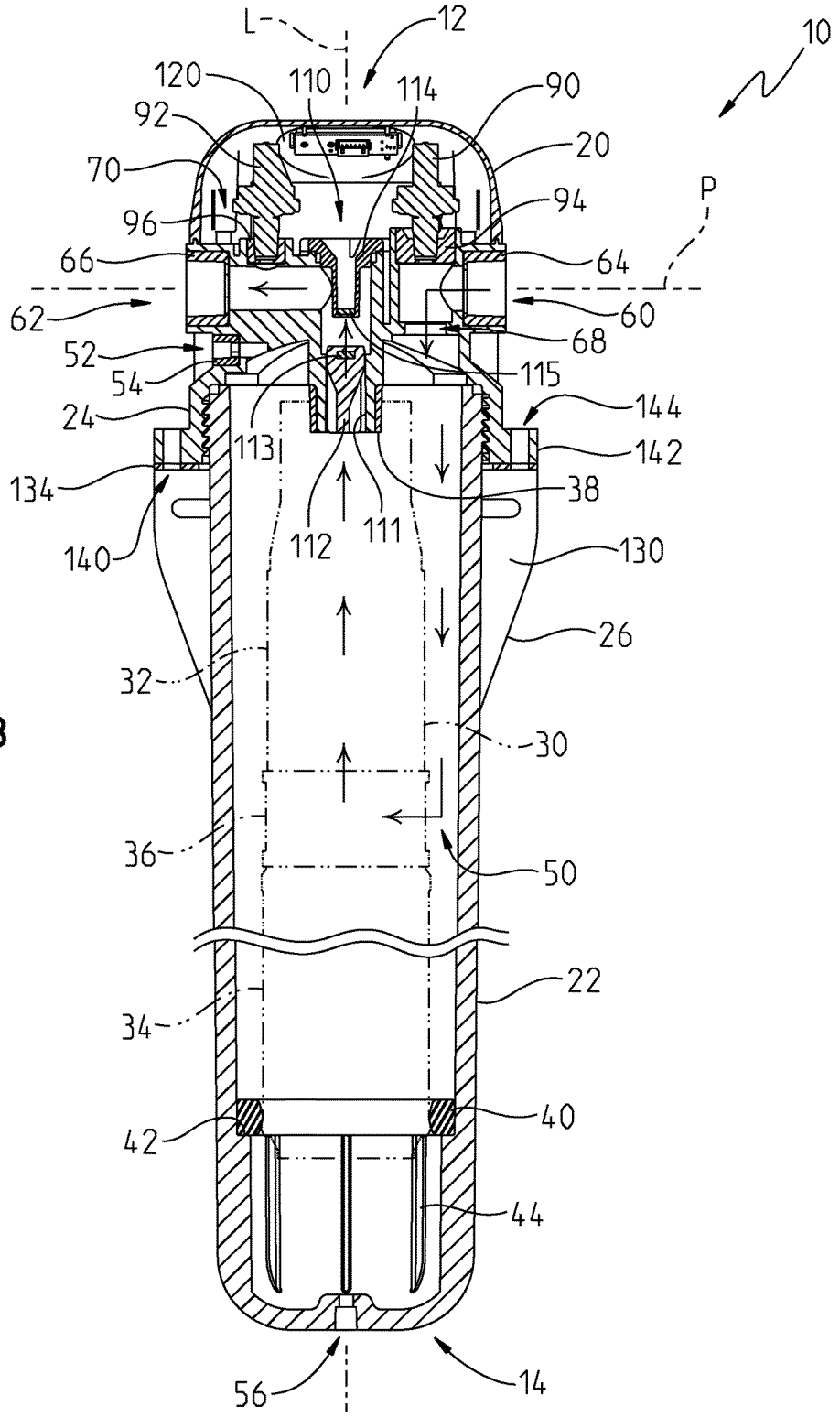
FIG. 3 is a cross-sectional view of the pump unit of FIG. 1 taken along line 3-3 of FIG. 1.

Referring next to FIG. 2, pump unit 10 includes a submersible pump/motor assembly (PMA) 30. PMA 30 is generally cylindrical in shape and is arranged inside tank 22 along the longitudinal axis L. PMA 30 includes a pump 32 arranged near first end 12 of pump unit 10, an electric motor 34 arranged near second end 14 of pump unit 10 to power the pump 32, and a screened fluid intake 36 positioned therebetween. Pump 32 may be a submersible, centrifugal pump having multiple impeller stages and associated diffusers. A suitable PMA 30 is the 92061513P pump/motor assembly available from Franklin Electric of Fort Wayne, Ind. Head 24 may be fitted with a pump adapter 38, such as a male National Pipe Thread Taper (NPT) adapter, to receive PMA 30, as shown in FIG. 3. When PMA 30 is active, PMA 30 may deliver fluid at a pressure of about 30, 40, or 50 psi, for example. When PMA 30 is inactive, fluid may travel freely through PMA 30 without a significant pressure change.

Figure 4:
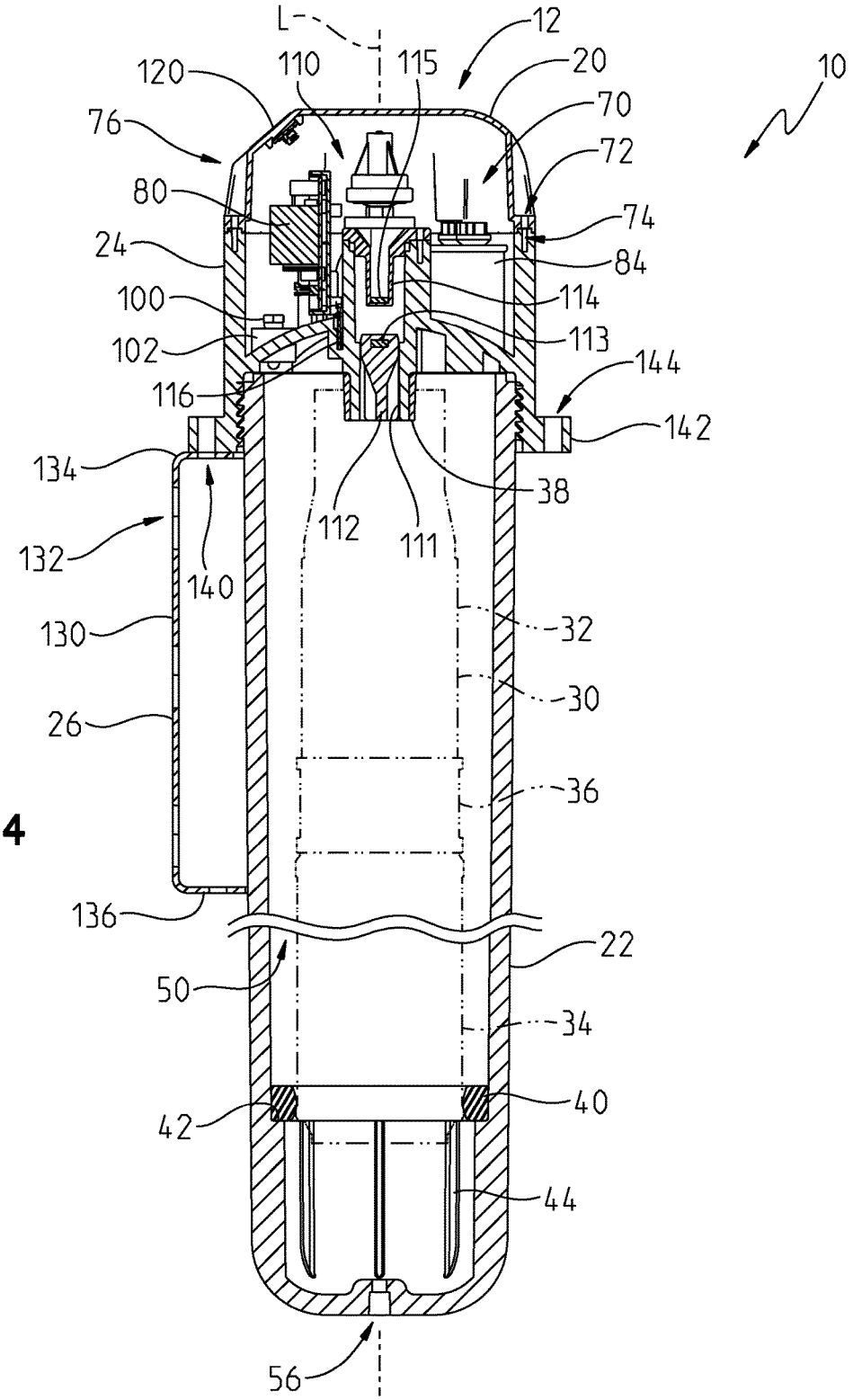
FIG. 4 is another cross-sectional view of the pump unit of FIG. 1 taken along line 4-4 of FIG. 1.
Figure 8:
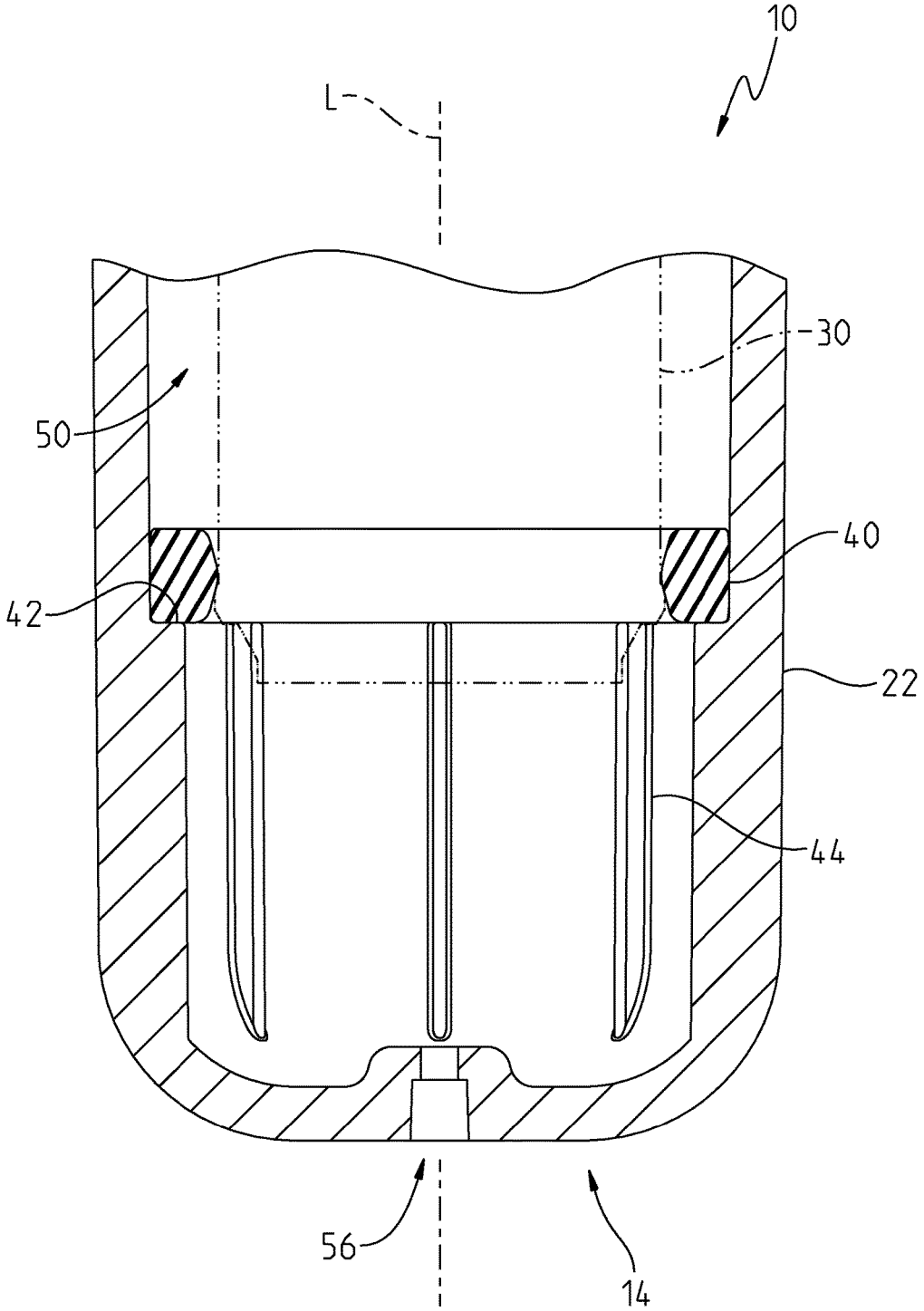
FIG. 8 is a detailed view of a bottom end of the pump unit of FIG. 4.

Referring next to FIGS. 3, 4, and 8, a support ring 40 is provided in second end 14 of pump unit 10 between tank 22 and PMA 30 (shown in phantom). The support ring 40 is configured to support PMA 30, stabilize PMA 30, and absorb vibrations of PMA 30. The support ring 40 may be constructed of rubber or another suitable material. In the illustrated embodiment, tank 22 includes a plurality of internal ribs 44 each defining a shoulder 42 upon which the support ring 40 rests.

Referring still to FIGS. 3 and 4, head 24 is removably coupled to tank 22 to define a fluid chamber 50 that is configured to hold fluid around PMA 30 (shown in phantom). In the illustrated embodiment of FIGS. 3 and 4, head 24 is threadably coupled onto tank 22, but other suitable coupling mechanisms may be used to couple head 24 to tank 22. When head 24 is coupled to tank 22, as shown in FIGS. 3 and 4, fluid in the fluid chamber 50 is prevented from leaking. When head 24 is removed from tank 22, the fluid chamber 50 is exposed to allow access to the elements contained therein, including PMA 30, such as for maintenance and repair.

Near first end 12 of pump unit 10, an air vent opening 52 is provided from the fluid chamber 50, as shown in FIG. 3. The air vent opening 52 may be fitted with a vent adapter 54, such as a female NPT adapter, to receive a suitable air bleed valve (not shown) that allows a user to selectively open and close the air vent opening 52. Before operating pump unit 10, the user may open the air bleed valve in the air vent opening 52 to remove excess air from the fluid chamber 50. During normal operation of pump unit 10, the user may close the air bleed valve in the air vent opening 52.

Near second end 14 of pump unit 10, a fluid drain opening 56 is provided from the fluid chamber 50. The fluid drain opening 56 may include a removable plug (not shown) that allows the user to selectively open and close the fluid drain opening 56. During normal operation of pump unit 10, the user may install the plug in the fluid drain opening 56 to retain fluid in the fluid chamber 50.

As shown in FIG. 3, head 24 defines a fluid inlet 60 into the fluid chamber 50 and a fluid outlet 62 from the fluid chamber 50. The fluid inlet 60 and the fluid outlet 62 are illustratively arranged along a pipe axis P. In this manner, pump unit 10 may be positioned "in-line" with a pipe (not shown) along the pipe axis P without having to bend or re-route the pipe. An inlet pipe adapter 64 is provided at the fluid inlet 60 to mate with the incoming pipe, and an outlet pipe adapter 66 is provided at the fluid outlet 62 to mate with the outgoing pipe. The inlet and outlet pipe adapters 64, 66, may include female NPT adapters, for example. In the illustrated embodiment of FIG. 3, the pipe axis P is perpendicular to the longitudinal axis L.

Arrows are provided in FIG. 3 to illustrate the fluid flow path through pump unit 10. PMA 30 is arranged in fluid communication with the fluid inlet 60 and the fluid outlet 62, so the fluid travels into the fluid inlet 60, through PMA 30, and out of the fluid outlet 62. More specifically, fluid from the incoming pipe (not shown) enters pump unit 10 through the fluid inlet 60. Next, the fluid enters the fluid chamber 50 around PMA 30. Then, the fluid in the fluid chamber 50 adjacent to fluid intake 36 enters PMA 30 through fluid intake 36. When PMA 30 is operating, the fluid is pressurized by pump 32 of PMA 30. Finally, the fluid exits pump unit 10 through the fluid outlet 62 and continues through the outgoing pipe (not shown).

Pump unit 10 may include one or more check valves to prevent fluid from traveling in a direction opposite the fluid flow path shown in FIG. 3. A first check valve (not shown) may be located at or near the fluid inlet 60 to prevent the backflow of fluid from the fluid inlet 60. For example, the first check valve may be located in a pocket 68, which is arranged in a longitudinal flow path between the fluid inlet 60 and the fluid chamber 50 in FIG. 3. A second check valve (not shown) may be located at or near the fluid outlet 62 to keep maintain downstream pressure and to prevent the backflow of fluid through PMA 30 and into tank 22. For example, the second check valve may be incorporated into the discharge end of PMA 30 near fluid outlet 62.

Figure 6:
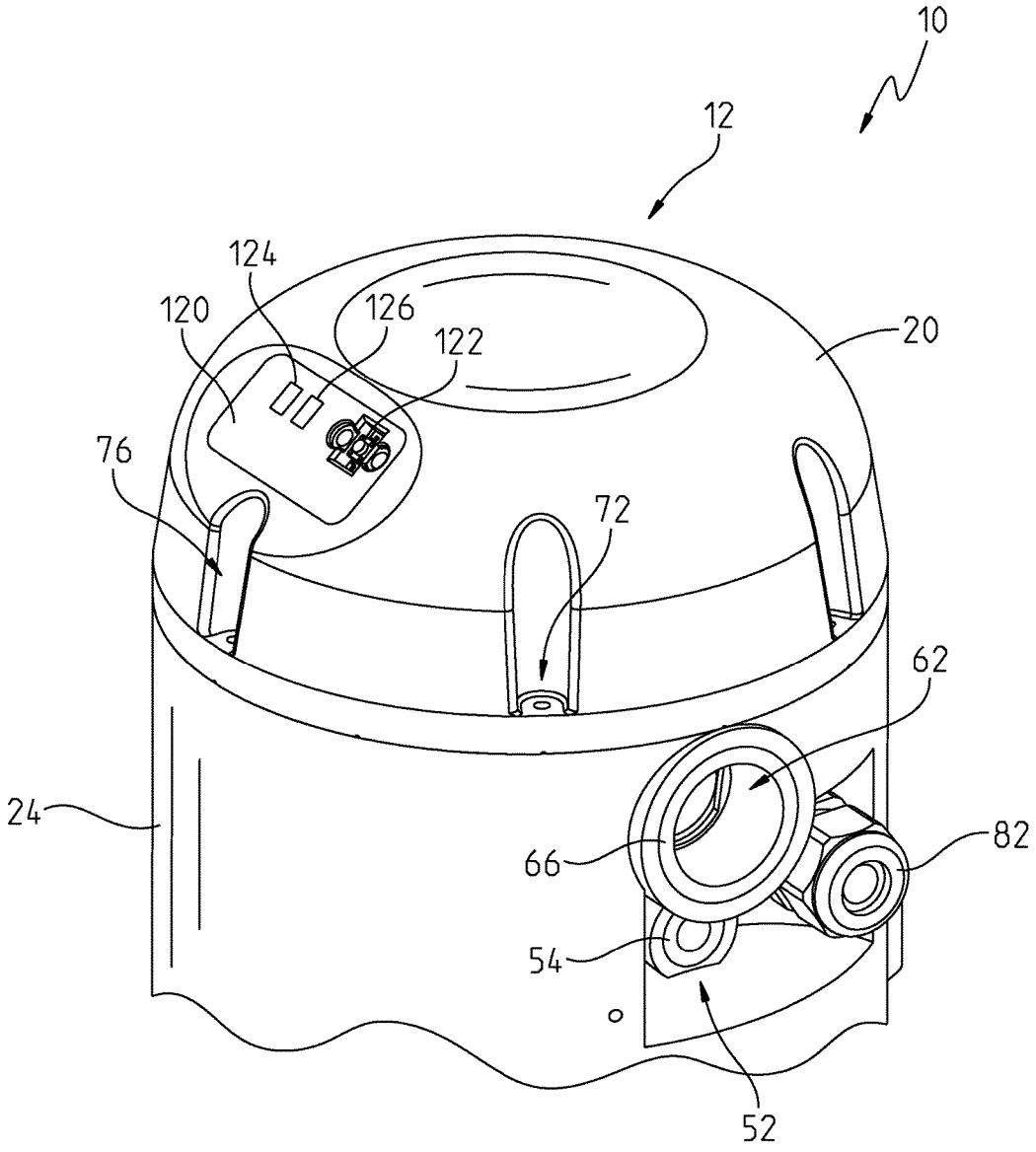
FIG. 6 is a perspective view of a top end of the pump unit of FIG. 1 shown with the cap coupled to the head.
Figure 7:
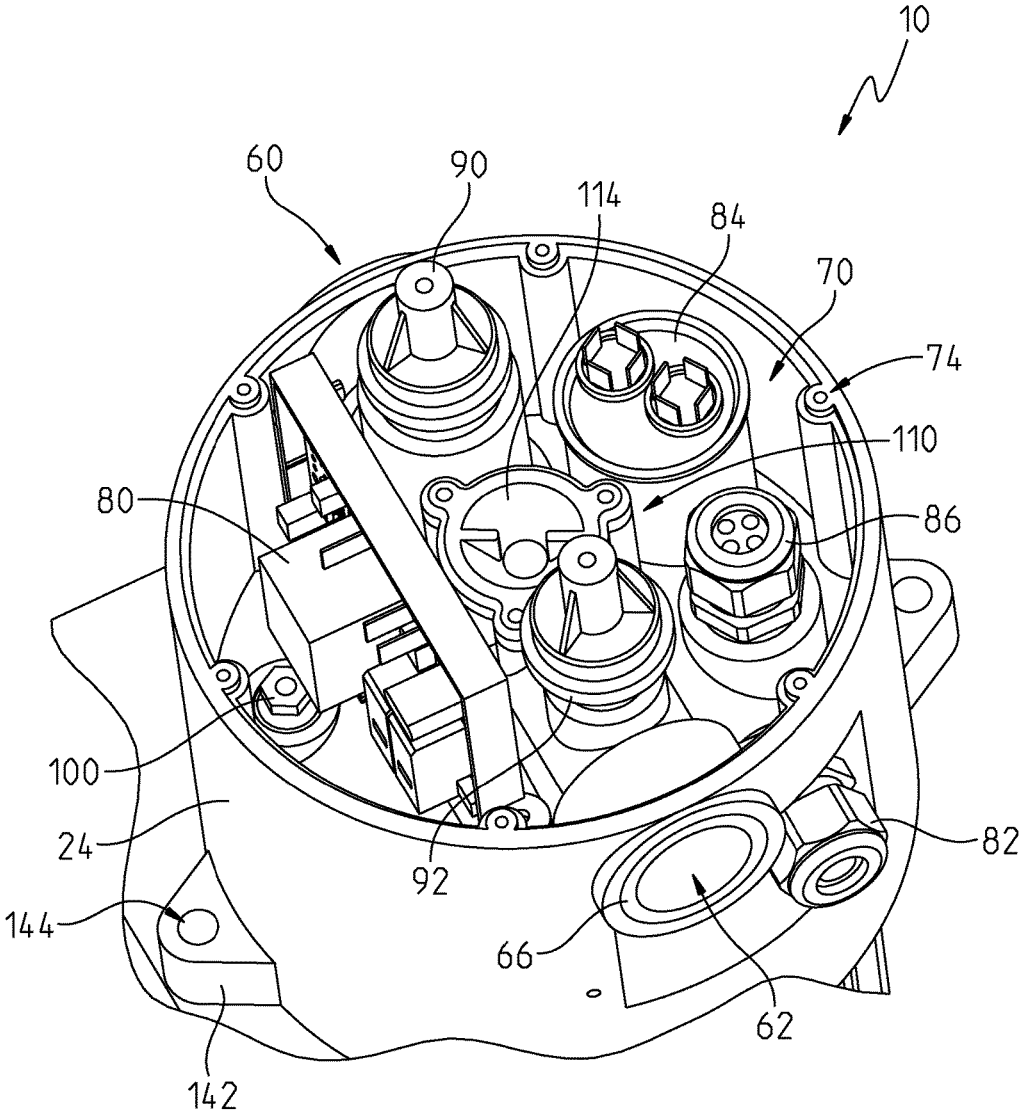
FIG. 7 is a perspective view of the top end of the pump unit similar to FIG. 6 but shown with the cap removed from the head.

Referring next to FIGS. 6 and 7, cap 20 is removably coupled to head 24 to define a control chamber 70 that houses and protects various electronic and control elements of pump unit 10, which are described further below. In the illustrated embodiment, cap 20 is coupled to head 24 by inserting a plurality of threaded fasteners (not shown) through apertures 72 in cap 20, which are shown in FIG. 6, and into corresponding threaded receptacles 74 in head 24, which are shown in FIG. 7, but other suitable coupling mechanisms may be used to couple cap 20 to head 24. The outer periphery of cap 20 illustratively includes channels 76 adjacent to each aperture 72 to facilitate insertion of the threaded fasteners into apertures 72. When cap 20 is coupled to head 24, as shown in FIG. 6, the control chamber 70 is enclosed to house and protect the elements contained therein. Advantageously, cap 20 may be coupled to head 24 in a desired orientation to facilitate access to user interface 120 on cap 20, which is described further below. When cap 20 is removed from head 24, as shown in FIG. 7, the control chamber 70 is exposed to allow access to the elements contained therein, such as for maintenance and repair.

As shown in FIG. 7, the control chamber 70 includes an electronic controller 80. Controller 80 is configured to communicate with an external power source (not shown). Controller 80 may receive electronic inputs from the external power source to determine whether PMA 30 is operating in an over-voltage or under-voltage condition, for example. A first strain relief bushing 82 may be provided in head 24 to seal and protect the electrical wires (not shown) that pass through head 24 between controller 80 and the external power source. Controller 80 is also programmed to receive and process various inputs to operate pump unit 10. Controller 80 may include one or more timers (not shown).

The control chamber 70 of FIG. 7 also includes a capacitor 84 communicatively coupled to the controller 80 to control motor 34 of PMA 30 (FIG. 2). In this embodiment, motor 34 may be a permanent-split capacitor (PSC) motor. A second strain relief bushing 86 may be provided in head 24 to seal and protect the electrical wires (not shown) that pass between controller 80, capacitor 84, and PMA 30.

As shown in FIG. 3, the control chamber 70 further includes an inlet pressure sensor 90 and an outlet pressure sensor 92, both of which are communicatively coupled to the controller 80. Head 24 may be fitted with sensor adapters 94, 96, such as a female NPT adapters, to hold and retain the inlet and outlet pressure sensors 90, 92, respectively, in the control chamber 70. The inlet pressure sensor 90 is arranged along the fluid inlet 60 to the fluid chamber 50 to sense the inlet fluid pressure upstream of PMA 30 (i.e., the fluid pressure in the incoming pipe), and the outlet pressure sensor 92 is arranged along the fluid outlet 62 from the fluid chamber 50 to sense the outlet fluid pressure downstream of PMA 30 (i.e., the fluid pressure in the outgoing pipe). Suitable pressure sensors 90, 92 include the 83435 pressure switches available from Honeywell Sensing and Control of Freeport, Ill.

According to an exemplary embodiment of the present disclosure, the inlet and outlet pressure sensors 90, 92, are pressure switches. When the inlet fluid pressure reaches a predetermined threshold, inlet pressure switch 90 sends an appropriate ON/OFF signal to controller 80. Similarly, when the outlet fluid pressure reaches a predetermined threshold, outlet pressure switch 92 sends an appropriate ON/OFF signal to controller 80. The inlet pressure switch 90 may be controlled independently of the outlet pressure switch 92, such that the inlet fluid pressure threshold associated with the inlet pressure switch 90 may differ from the outlet fluid pressure threshold associated with the outlet pressure switch 92. In certain embodiments, the inlet fluid pressure threshold associated with the inlet pressure switch 90 exceeds the outlet fluid pressure threshold associated with the outlet pressure switch 92. The inlet fluid pressure threshold associated with the inlet pressure switch 90 may be about 30, 40, or 50 psi, and the outlet fluid pressure threshold associated with the outlet pressure switch 92 may be about 20, 30, or 40 psi, for example.

In other embodiments, the inlet and outlet pressure sensors 90, 92, may be pressure transducers that actually measure the inlet and outlet fluid pressures, respectively. However, pressure switches are generally more affordable and simplistic than pressure transducers.

Figure 5:
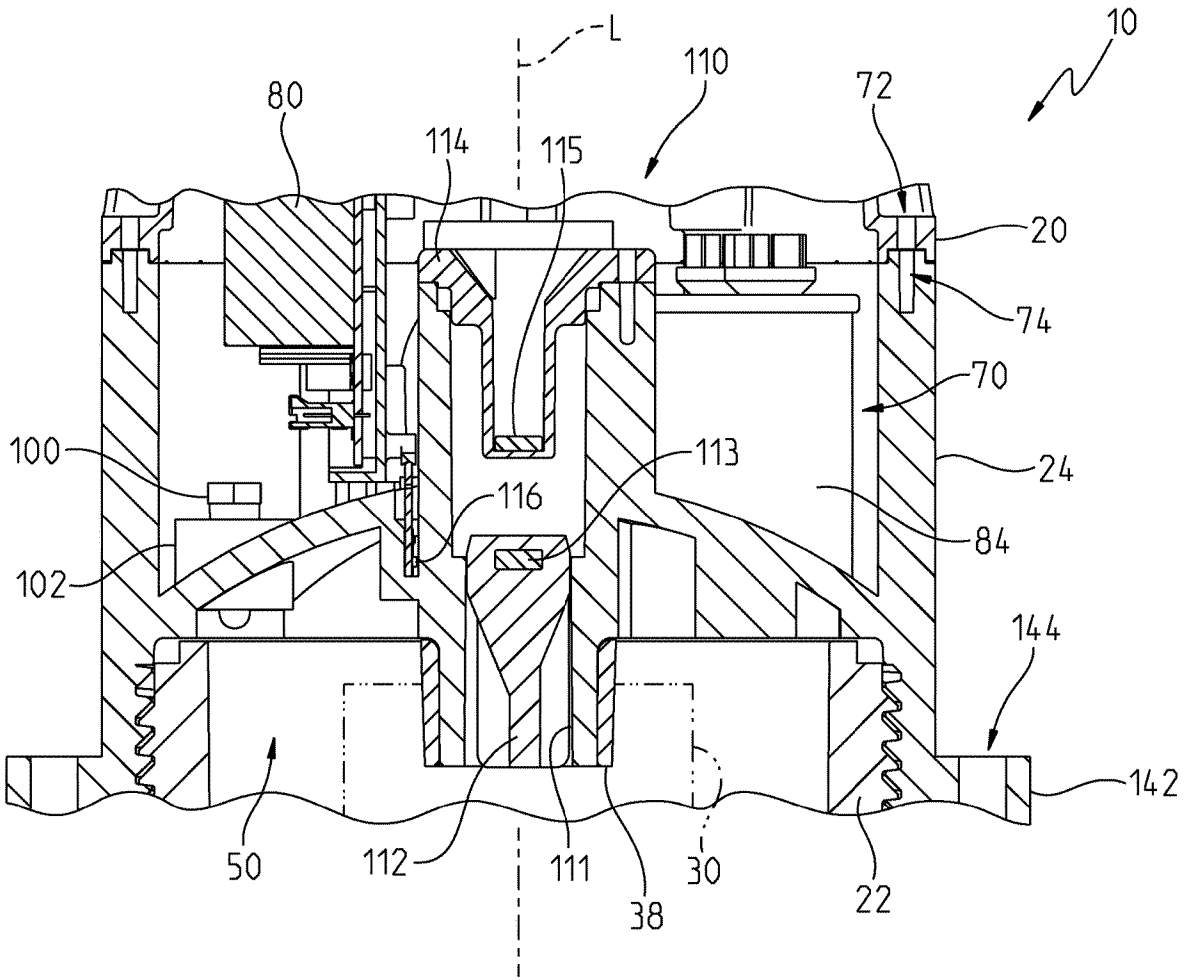
FIG. 5 is a detailed cross-sectional view of the head of the pump unit of FIG. 4.

As shown in FIGS. 4 and 5, the control chamber 70 further includes an optional temperature sensor 100, specifically a thermistor, which is communicatively coupled to the controller 80. Head 24 may be fitted with a sensor adapter 102, such as a female NPT adapter, to hold and retain temperature sensor 100 in the control chamber 70. The temperature sensor 100 thermally communicates with the fluid chamber 50 and is configured to measure the temperature of the fluid in the fluid chamber 50. In the illustrated embodiment of FIG. 4, the temperature sensor 100 is configured to measure the temperature of the fluid surrounding PMA 30 before the fluid is pressurized by PMA 30. Controller 80 may then determine whether the measured fluid temperature is at or above a predetermined threshold, such as about 120, 130, or 140° F., for example. Such temperatures may suggest that the fluid surrounding PMA 30 is acquiring too much heat from PMA 30, which may trigger a fault condition. A suitable temperature sensor 100 includes the USP14539 temperature sensor available from U.S. Sensor Corp. of Orange, Calif.

Referring still to FIGS. 4 and 5, the control chamber 70 further includes a flow sensor assembly 110 communicatively coupled to the controller 80. In FIGS. 4 and 5, the flow sensor assembly 110 is arranged along the longitudinal axis L to sense the flow of the fluid exiting PMA 30, but the location and orientation of the flow sensor assembly 110 may vary. The illustrative flow sensor assembly 110 includes a moveable flow piston 112 having an embedded target magnet 113, a stationary flow cap 114 having a spring magnet 115 that repels the target magnet 113, and a flow sensor 116 communicatively coupled to the controller 80 and configured to sense the target magnet 113. A suitable flow piston 112 is the C25A flow piston available from Kelco Engineering Pty. Ltd. of Brookvale, Australia.

Head 24 includes a cylinder 111 that receives the flow piston 112. The inner diameter of the cylinder 111 closely approximates the outer diameter of the flow piston 112. In operation, after exiting PMA 30, the fluid in cylinder 111 moves the flow piston 112 and flows past the flow piston 112. At high flow rates, the fluid will force the flow piston 112 to move toward the flow cap 114 and against the repelling force of the spring magnet 115. In other words, high flow rates will overcome the repelling force of the spring magnet 115 and move the flow piston 112 toward the flow cap 114. As the flow rate decreases, movement of the flow piston 112 toward the flow cap 114 will also decrease under the repelling force of the spring magnet 115. Even at very low flow rates, the close relationship between the flow piston 112 and the cylinder 111 will cause some movement of the flow piston 112.

As described above, the flow sensor 116 is configured to sense the target magnet 113 in the moveable flow piston 112. When the flow piston 112 is at rest under no fluid flow, the target magnet 113 in the flow piston 112 may be generally aligned with and in close proximity to the flow sensor 116, as shown in FIG. 5. As the fluid forces the flow piston 112 to move toward the flow cap 114, the flow sensor 116 may detect movement of the target magnet 113 in the flow piston 112.

According to an exemplary embodiment of the present disclosure, flow sensor 116 is a Hall effect sensor that provides a varying output voltage to controller 80 based on the distance between the flow sensor 116 and the target magnet 113. In certain embodiments, controller 80 may interpret the output voltage from flow sensor 116 as a switch having ON/OFF conditions. At and above (or below) a predetermined output voltage, controller 80 may determine that the fluid flow rate is sufficiently high (ON), such as about 0.2, 0.3, or 0.4 gallons per minute (GPM) or more, for example. Otherwise, controller 80 may determine that the fluid flow rate is too low (OFF). In other embodiments, controller 80 may calculate the actual fluid flow rate based on the output voltage from flow sensor 116.

Returning to FIG. 6, a user interface 120 is provided on an exposed surface of cap 20 to communicate information between controller 80 and the user. As described above, the orientation of cap 20 on head 24 may be varied to facilitate access to user interface 120 on cap 20. The illustrative user interface 120 includes a push button 122 that allows the user to selectively power pump unit 10 ON/OFF. The push button 122 may also be used to reset pump unit 10 after a fault condition. The illustrative user interface 120 also includes a plurality of light-emitting diodes (LED's) 124, 126, to communicate information to the user. For example, the first LED 124 may emit a solid green light to communicate that pump unit 10 is powered on but not operating PMA 30 in a standby mode, and a flashing green light to communicate that pump unit 10 is powered on and operating PMA 30 in an active mode. The second LED 126 may emit a solid red light to communicate that pump unit 10 is powered off, and a flashing red light to communicate a fault mode.

Returning to FIGS. 1-4, mounting bracket 26 of pump unit 10 includes a body, i.e., central body 130. Central body 130 includes a plurality of apertures 132 that receive fasteners (not shown), such as screws, for coupling mounting bracket 26 to a support structure, as described further below. The illustrative central body 130 is spaced apart from tank 22 and extends generally parallel to longitudinal axis L. At either end of central body 130, mounting bracket 26 includes a first arm 134 that extends 90 degrees from central body 130 to interact with head 24 and a second arm 136 that extends 90 degrees from central body 130 to interact with tank 22 at a location about halfway between first end 12 and second end 14. First and second arms 134, 136, of mounting bracket 26 are generally U-shaped near tank 22 to partially surround and support tank 22. More specifically, first arm 134 of mounting bracket 26 is configured to surround about half (i.e., 180 degrees) of tank 22, and second arm 136 of mounting bracket 26 is configured to surround about a quarter (i.e., 90 degrees) of tank 22.

First arm 134 of mounting bracket 26 is removably coupled to head 24. First arm 134 of mounting bracket 26 includes a plurality of apertures 140, illustratively three apertures 140, and head 24 includes a plurality of flanges 142 that define apertures 144, illustratively four flanges 142 and four apertures 144. A plurality of fasteners (not shown), such as nuts and bolts, may be inserted through apertures 140 in first arm 134 of mounting bracket 26 and through corresponding apertures 144 in flanges 142 of head 24 to secure mounting bracket 26 to head 24. Other suitable coupling mechanisms may be used to couple mounting bracket 26 to head 24.

Figure 9:
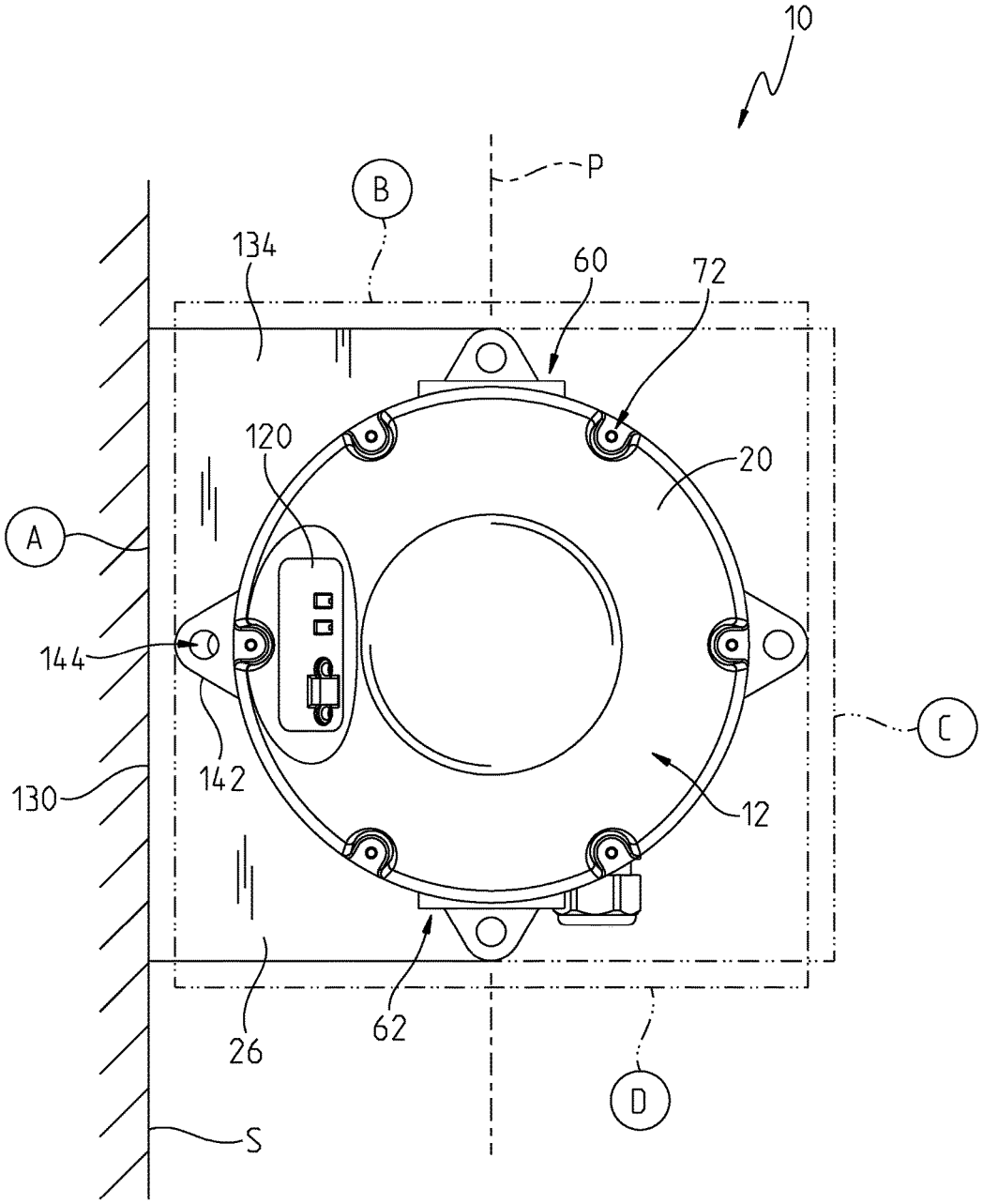
FIG. 9 is a top plan view of the pump unit of FIG. 1 shown with the mounting bracket coupled to a support structure.

Referring next to FIG. 9, mounting bracket 26 may be selectively rotated relative to head 24. In the illustrated embodiment of FIG. 9, mounting bracket 26 may be coupled to pump unit 10 in one of four discrete positions A-D, where the four flanges 142 and the four apertures 144 in head 24 correspond to each of the four positions A-D. In position A (shown in solid) (i.e., a 9 o'clock position), mounting bracket 26 is positioned on the same side of pump unit 10 as user interface 120. In position B (shown in phantom) (i.e., a 12 o'clock position), mounting bracket 26 is rotated 90 degrees from position A and is positioned on the same side of pump unit 10 as the fluid inlet 60. In position C (shown in phantom) (i.e., a 3 o'clock position), mounting bracket 26 is rotated 90 degrees from position B and is positioned on the opposite side of pump unit 10 from user interface 120. In position D (shown in phantom) (i.e., a 6 o'clock position), mounting bracket 26 is rotated 90 degrees from position C and is positioned on the same side of pump unit 10 as the fluid outlet 62. Although mounting bracket 26 has four available positions A-D in FIG. 9 which are spaced apart at 90 degree intervals, it is within the scope of the present disclosure that the number of available positions and the orientation of each position may vary. In certain embodiments, mounting bracket 26 may be rotated to an infinite (i.e., non-discrete) number of positions relative to pump unit 10.

Because first arm 134 of mounting bracket 26 is shown with three apertures 140 and head 24 is shown with four apertures 144, three of the apertures 144 in head 24 may be occupied and the one remaining aperture 144 in head 24 may be unoccupied when mounting bracket 26 is secured to head 24. In FIG. 9, for example, where mounting bracket 26 is secured to head 24 in position A, fasteners would be inserted into the aperture 144 of head 24 corresponding to position A, as well as the apertures 144 of head 24 corresponding to positions B and D on either side of position A. The aperture 144 of head 24 corresponding to position C opposite from position A may be unoccupied (See also FIG. 4).

Advantageously, when pump unit 10 is installed "in-line" with a pipe (not shown), the orientation of the fluid inlet 60 and the fluid outlet 62 may be controlled by the pipe axis P of the pipe. Regardless of the orientation of the pipe, however, mounting bracket 26 may be selectively rotated relative to head 24 of pump unit 10 to interact with an adjacent support structure. In FIG. 9, for example, mounting bracket 26 is coupled to head 24 in position A to interact with an adjacent support structure S.

Figure 10:
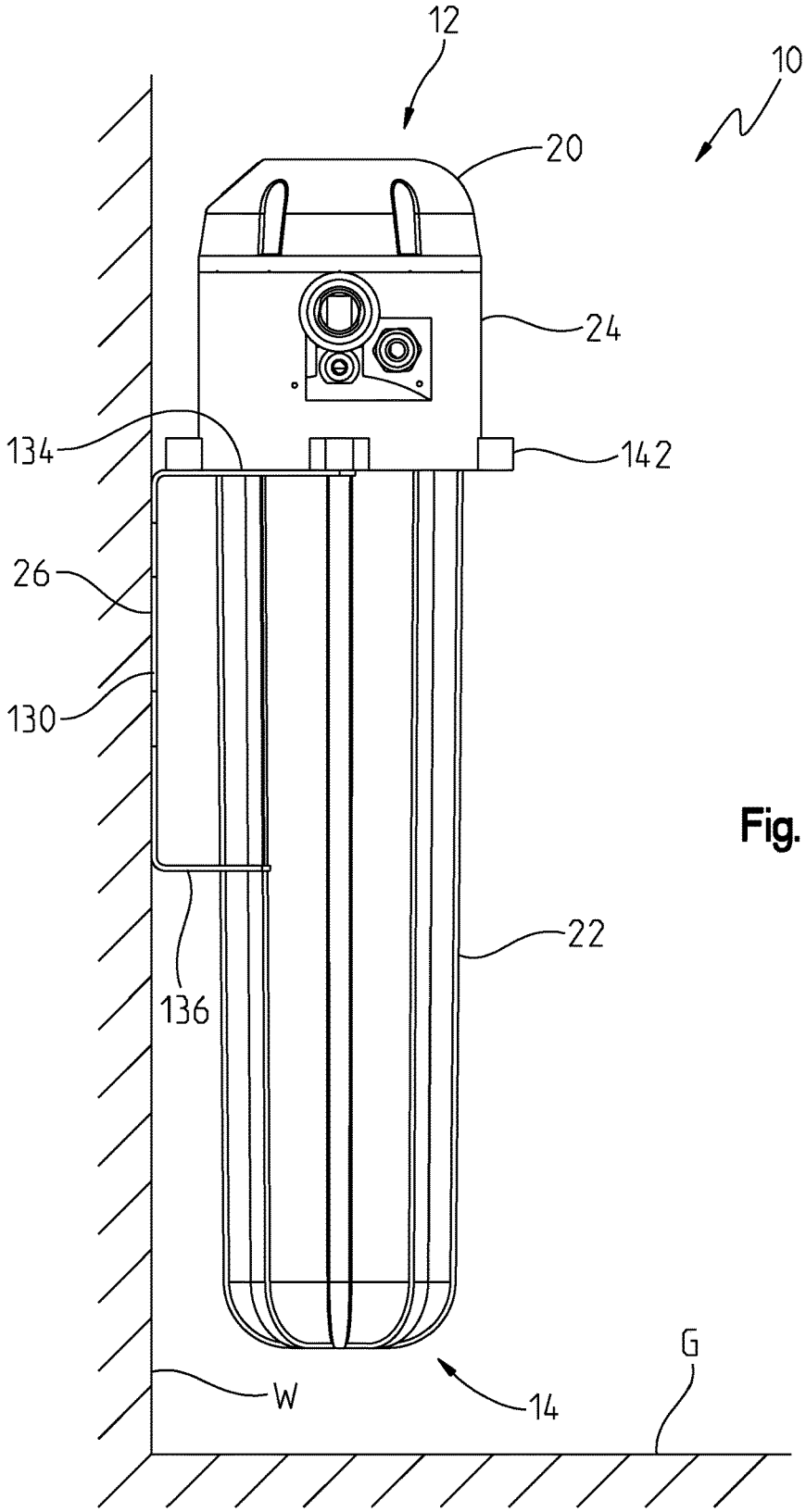
FIG. 10 is a side elevational view of the pump unit of FIG. 1 shown with the mounting bracket coupled to a vertical support structure.
Figure 11:
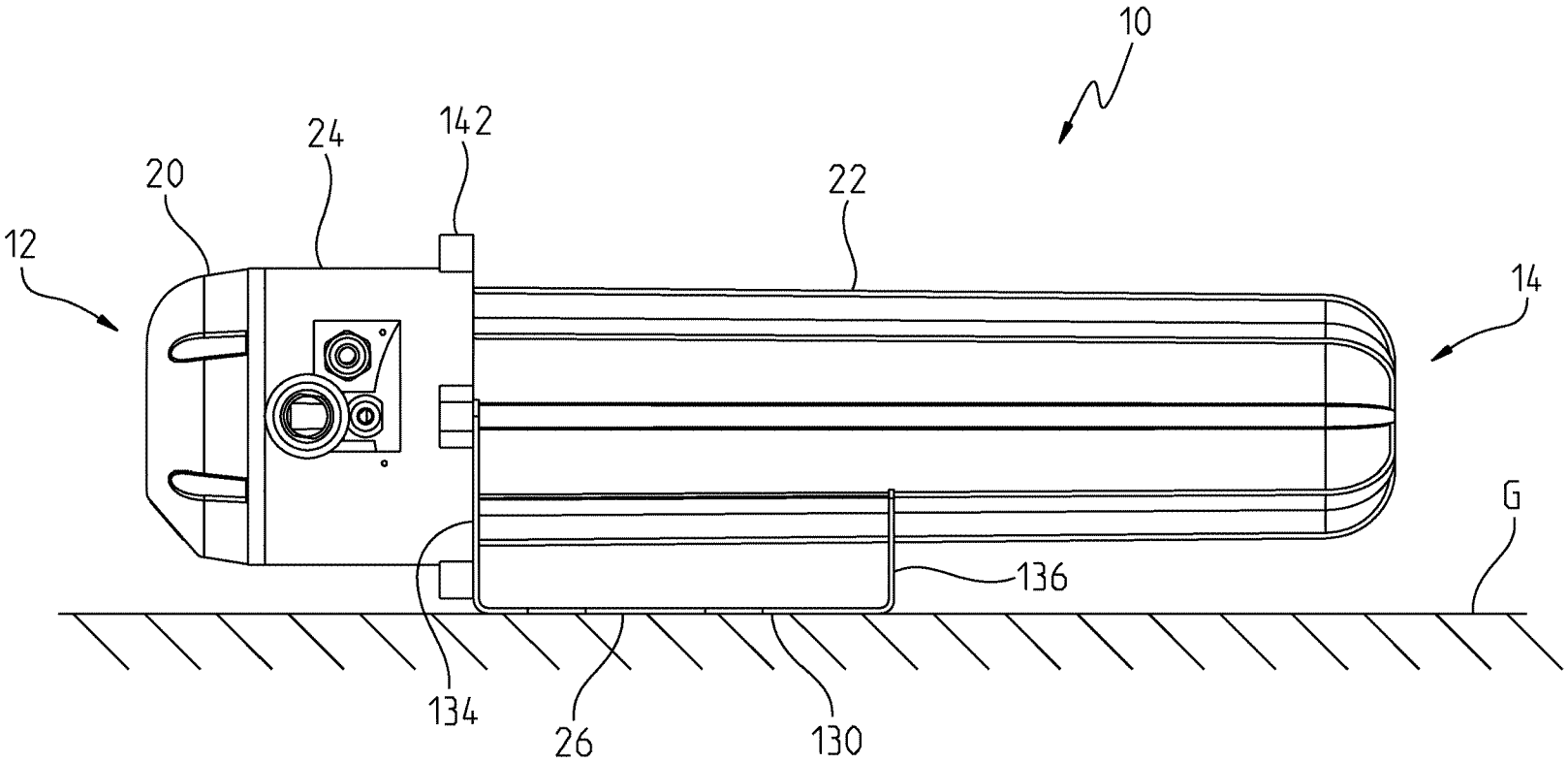
FIG. 11 is a side elevational view of the pump unit similar to FIG. 10 but shown with the mounting bracket coupled to a horizontal support structure.

The orientation of the entire pump unit 10 may also vary to accommodate the pipe and the adjacent support structure. In FIG. 10, the support structure is a wall W, and pump unit 10 is oriented vertically to interact with the wall W. More specifically, central body 130 of mounting bracket 26 is oriented vertically to interface with and fasten to the wall W. In this arrangement, first arm 134 of mounting bracket 26 extends horizontally to support flanges 142 of head 24, and second arm 136 of mounting bracket 26 extends horizontally to help stabilize tank 22 at a location about halfway between first end 12 and second end 14. Second end 14 of pump unit 10 may be spaced above the floor or ground G in this arrangement to allow access to the fluid drain opening 56 (FIG. 3) in second end 14 of pump unit 10. In FIG. 11, the support structure is the floor or ground G, and pump unit 10 is oriented horizontally to interact with the ground G. More specifically, central body 130 of mounting bracket 26 is oriented horizontally to interface with and fasten to the ground G. In this arrangement, first arm 134 of mounting bracket 26 extends vertically to support tank 22 at a location near flanges 142 of head 24, and second arm 136 of mounting bracket 26 extends vertically to support tank 22 at a location about halfway between first end 12 and second end 14.

Figure 12:
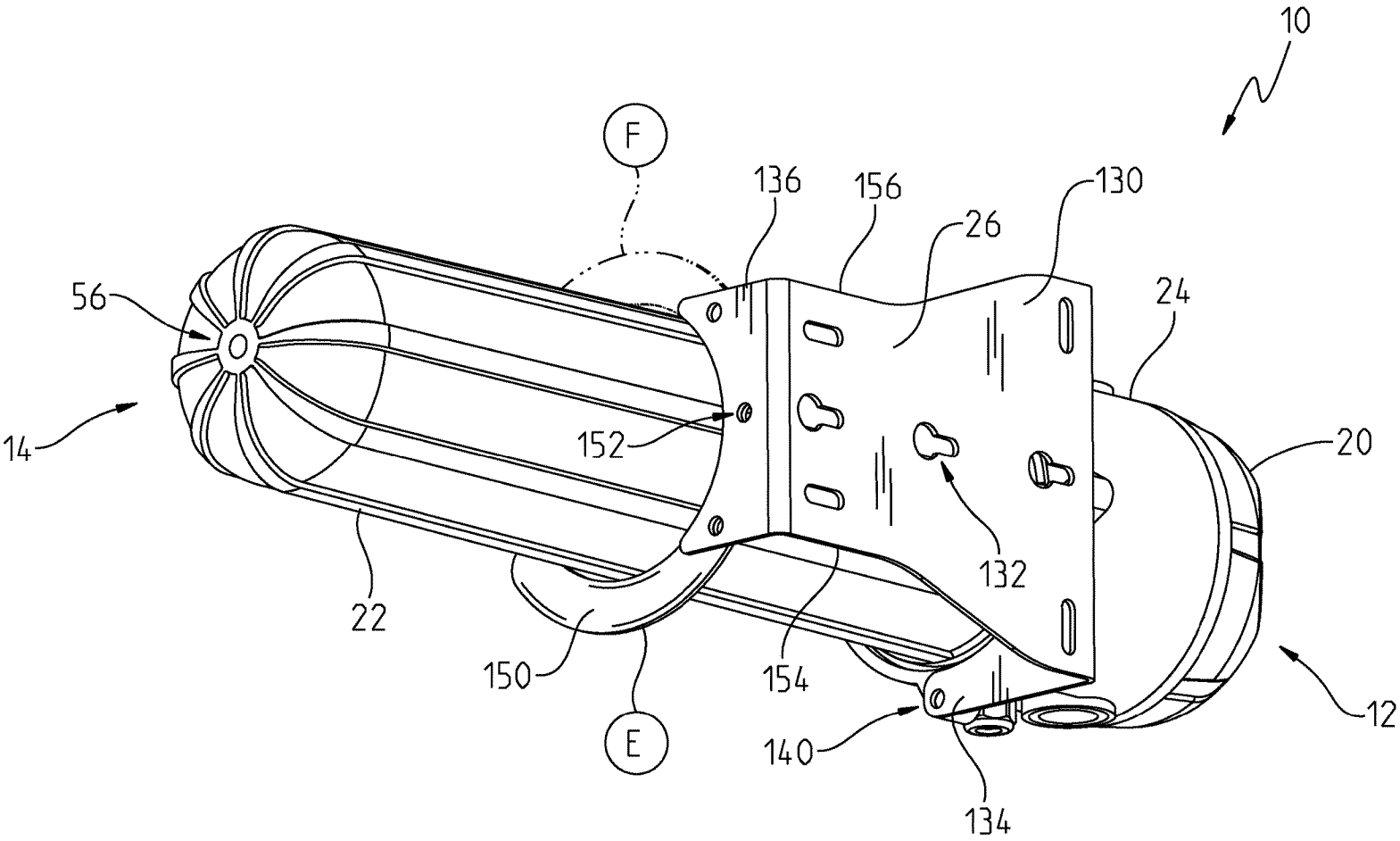
FIG. 12 is a perspective view of the pump unit of FIG. 1 shown with an auxiliary hook coupled to the mounting bracket.
Figure 13:
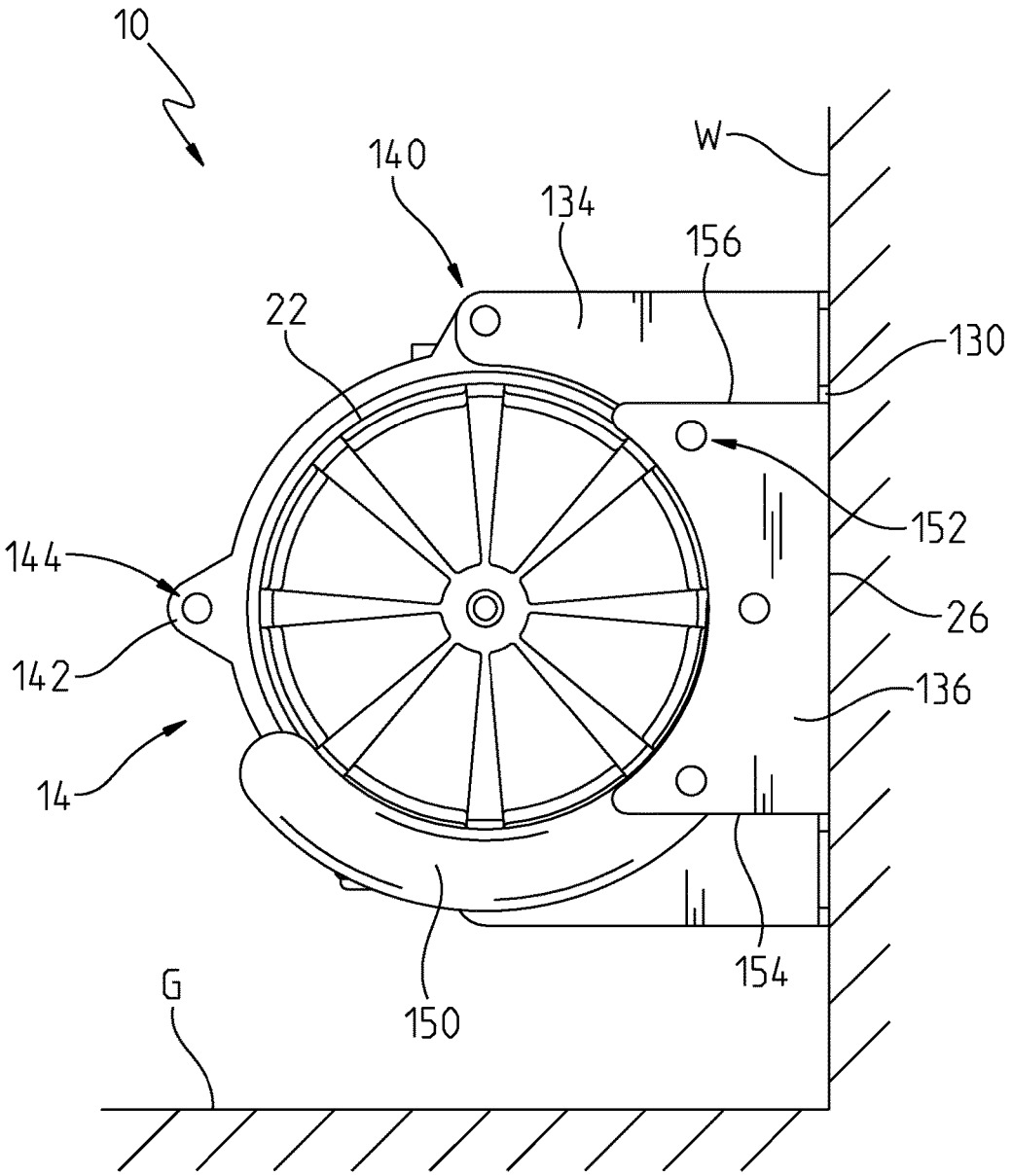
FIG. 13 is a bottom plan view of the pump unit of FIG. 12 shown with the mounting bracket coupled to a vertical support structure.

Referring next to FIGS. 12 and 13, an auxiliary hook 150 is removably coupled to second arm 136 of mounting bracket 26. Second arm 136 of mounting bracket 26 includes a plurality of apertures 152, illustratively three apertures 152, and hook 150 includes a plurality of corresponding apertures (not shown). A plurality of fasteners (not shown), such as nuts and bolts, may be inserted through apertures 152 in second arm 136 of mounting bracket 26 and through one or more of the corresponding apertures in hook 150 to secure hook 150 to mounting bracket 26. Other suitable coupling mechanisms may also be used to couple hook 150 to mounting bracket 26.

When pump unit 10 is oriented horizontally and mounted to a vertical wall W, as shown in FIG. 13, hook 150 serves as an extension of second arm 136 beneath tank 22 to support and stabilize tank 22 at the same general location as second arm 136, about halfway between first end 12 and second end 14. Without hook 150 in place beneath tank 22, second end 14 of tank 22 could fall or sag in this horizontal arrangement. With hook 150 in place, second arm 136 and hook 150 cooperate to surround about half (i.e., 180 degrees) of tank 22, as shown in FIG. 13. The other half of tank 22 remains exposed to accommodate insertion and removal of tank 22 relative to mounting bracket 26, as necessary.

The orientation of hook 150 relative to mounting bracket 26 may be selectively varied. In the illustrated embodiment of FIG. 12, hook 150 may be coupled to pump unit 10 in one of two discrete positions E and F. In position E (shown in solid), hook 150 extends from a first side 154 of mounting bracket 26, which is facing downward in FIG. 12. In position F (shown in phantom), which is a mirror image of position E, hook 150 is flipped over 180 degrees to extend from a second side 156 of mounting bracket 26, which is facing upward in FIG. 12. Hook 150 may be used in position F when second side 156 of mounting bracket 26 is rotated to face downward such that hook 150 would be located beneath tank 22.

Figure 14:
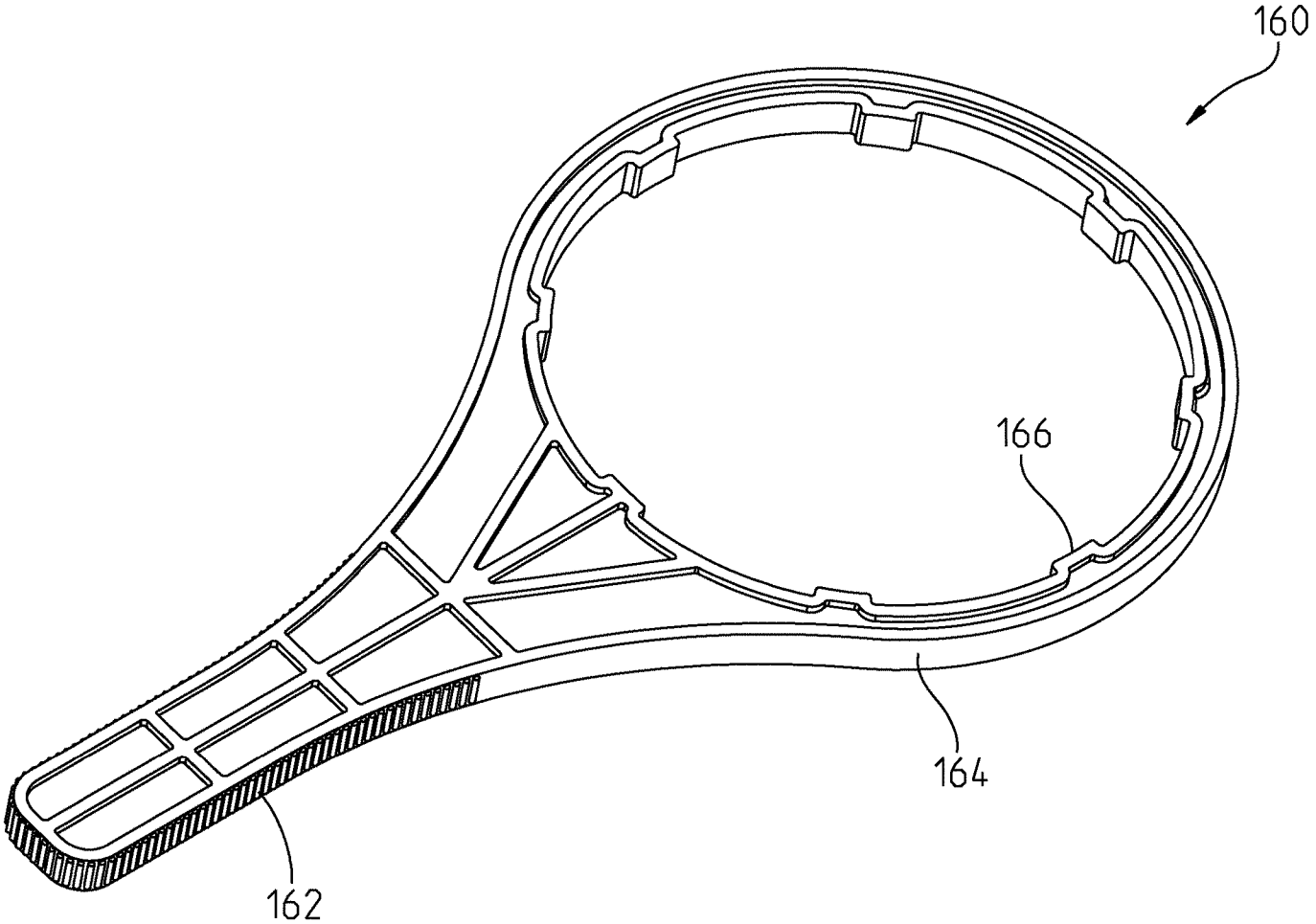
FIG. 14 is a perspective view of a tool for use with the pump unit of FIG. 1.

Referring next to FIG. 14, a tool 160 is provided for separating tank 22 from head 24. As shown in FIGS. 3 and 4, tank 22 may be threadably coupled to head 24. In this embodiment, tool 160 may be used to rotate tank 22 relative to head 24 to unthread tank 22 from head 24. For example, tool 160 may be used to unthread tank 22 from head 24 when head 24 is secured to a pipe (not shown) and tank 22 or the contents thereof require service or repair. The illustrative tool 160 of FIG. 14 includes a handle 162, a circular body 164, and a plurality of fingers 166 that extend radially inwardly from body 164. In operation, the user slides body 164 of tool 160 onto tank 22 with fingers 166 sliding through corresponding grooves 168 (FIG. 1) in tank 22. Then, the user rotates handle 162 of tool 160 to transfer rotational movement from fingers 166 to tank 22, similar to a wrench.

The operation of pump unit 10 will now be described with reference to method 200 of FIGS. 15A and 15B. It is within the scope of the present disclosure that the order of the following steps may vary. In general, the following steps may be performed by controller 80 in communication with other elements of pump unit 10, which are described above with reference to FIGS. 6 and 7.

In step 202 of method 200, controller 80 determines whether the user has powered on pump unit 10 via push button 122. If pump unit 10 is powered off, controller 80 may prevent operation of PMA 30 and activate the second LED 126 to emit a solid red light. If pump unit 10 is powered on, controller 80 may place PMA 30 in a standby mode and activate the first LED 124 to emit a solid green light. Controller 80 may then continue to step 204 to determine whether to operate PMA 30. When PMA 30 is powered off or on standby, fluid may travel freely through PMA 30 without a significant pressure change.

In step 204 of method 200, controller 80 communicates with the inlet pressure switch 90 to determine whether the inlet fluid pressure is at or above a predetermined threshold, such as about 40 psi. If the inlet fluid pressure is sufficiently high (i.e., at or above the threshold), controller 80 need not operate PMA 30 to boost the inlet fluid pressure, and controller 80 may return to the standby mode. If the inlet fluid pressure is too low (i.e., below the threshold), controller 80 may continue to step 206 to determine whether to operate PMA 30.

A delay timer may be provided to ensure that the inlet fluid pressure remains low for at least a minimum period of time (e.g., 10 seconds) before controller 80 continues to step 206 to avoid quick starts and stops of PMA 30 that could lead to unwanted pressure fluctuations. After step 204, controller 80 may initiate or continue running the delay timer without restarting the delay timer. While the delay timer is running and before the delay timer expires, controller 80 may return to step 204 to ensure that the inlet fluid pressure is still low. Eventually, when the delay timer expires, controller 80 may continue to step 206 to determine whether to operate PMA 30.

In step 206 of method 200, controller 80 determines whether a fault condition exists. In one embodiment, step 206 may involve communicating with the temperature sensor 100 to determine whether the fluid temperature is at or above a predetermined threshold, such as about 130° F. The fault condition may exist if the fluid temperature is too high (i.e., at or above the threshold) in this embodiment. In another embodiment, step 206 may involve communicating with an electronic input to determine whether an over-voltage or under-voltage condition exists. It is within the scope of the present disclosure that controller 80 may evaluate one or more fault conditions, such as both a temperature condition and a voltage condition. If a fault condition does exist, controller 80 may operate in a fault mode. In the fault mode, controller 80 may stop PMA 30, if necessary, and activate the second LED 126 to emit a flashing red light. If the fault condition does not exist, controller 80 may continue to step 208 to determine whether to operate PMA 30, as described further below.

A fault timer may be provided to determine whether the fault condition persists for a certain period of time (e.g., 7 or 8 hours). Each time controller 80 is in the fault mode, controller 80 may initiate or continue running the fault timer without restarting the fault timer. While the fault timer is running and before the fault timer expires, controller 80 may return to step 206 over certain time intervals (e.g., 15 minute, 30 minute, or 1 hour intervals) to determine whether the fault condition persists. Eventually, when the fault timer expires, controller 80 may deactivate pump unit 10 until the user manually resets and provides power to pump unit 10 via push button 122.

In the absence of a fault condition, controller 80 may continue to step 208 of method 200 as indicated above. In step 208 of method 200, controller 80 communicates with the flow sensor assembly 110 to determine whether the fluid flow rate is at or above a predetermined threshold, such as about 0.3 GPM. If the flow rate is too low (i.e., below the threshold), controller 80 may continue to step 210 to determine whether to operate PMA 30. If the flow rate is sufficiently high (i.e., at or above the threshold), controller 80 may operate PMA 30 in an active mode.

In step 210 of method 200, controller 80 communicates with the outlet pressure switch 92 to determine whether the outlet fluid pressure is at or above a predetermined threshold, such as about 30 psi. If the outlet fluid pressure is sufficiently high (i.e., at or above the threshold), controller 80 may return PMA 30 to the standby mode. If the outlet fluid pressure is too low (i.e., below the threshold), controller 80 may operate PMA 30 in the active mode to increase or boost the outlet fluid pressure. In the active mode, controller 80 may activate the first LED 124 to emit a flashing green light.

Figure 15A:
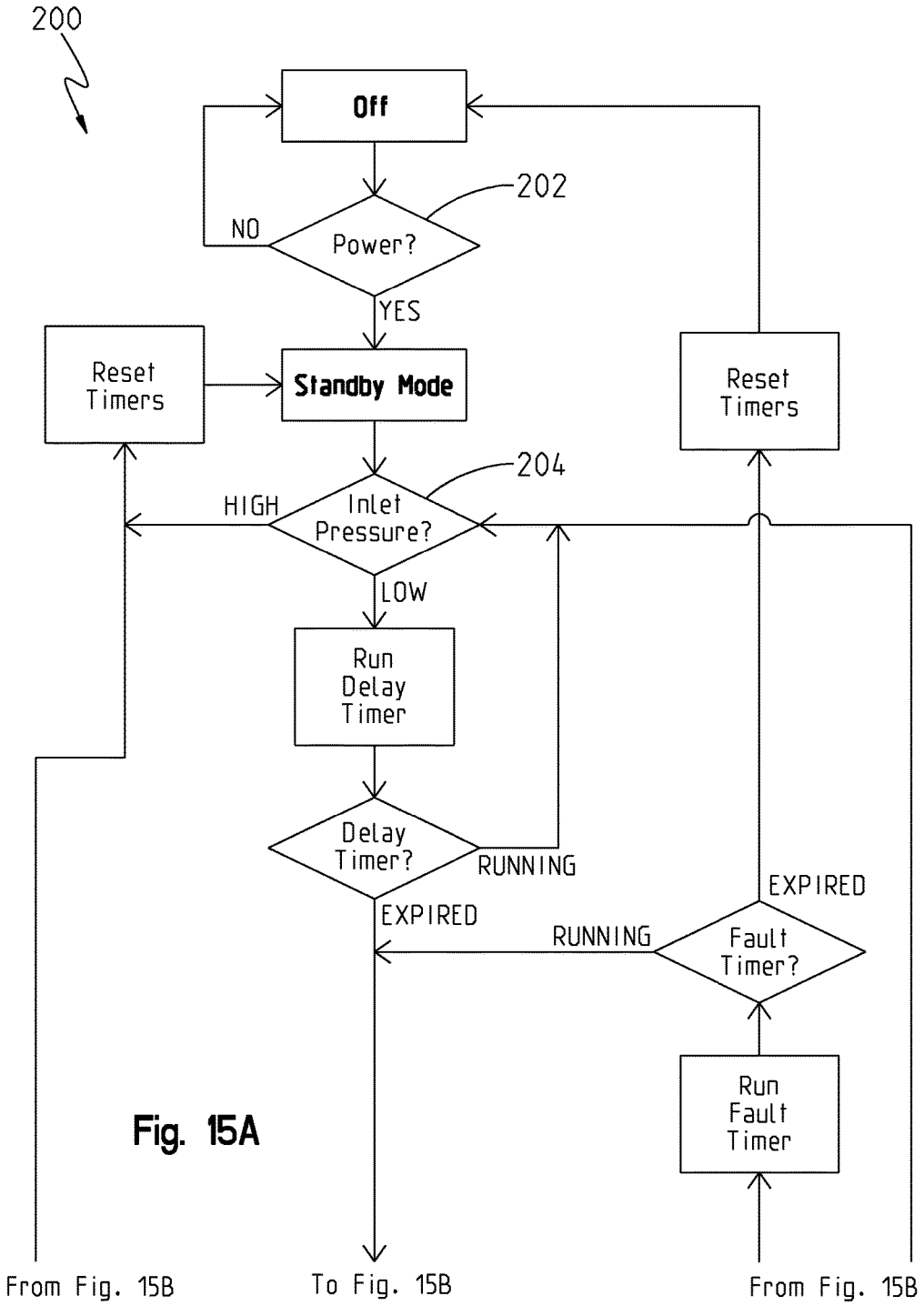
FIGS. 15A and 15B depict a flowchart showing an exemplary method for controlling the pump unit of FIG. 1.
Figure 15B:
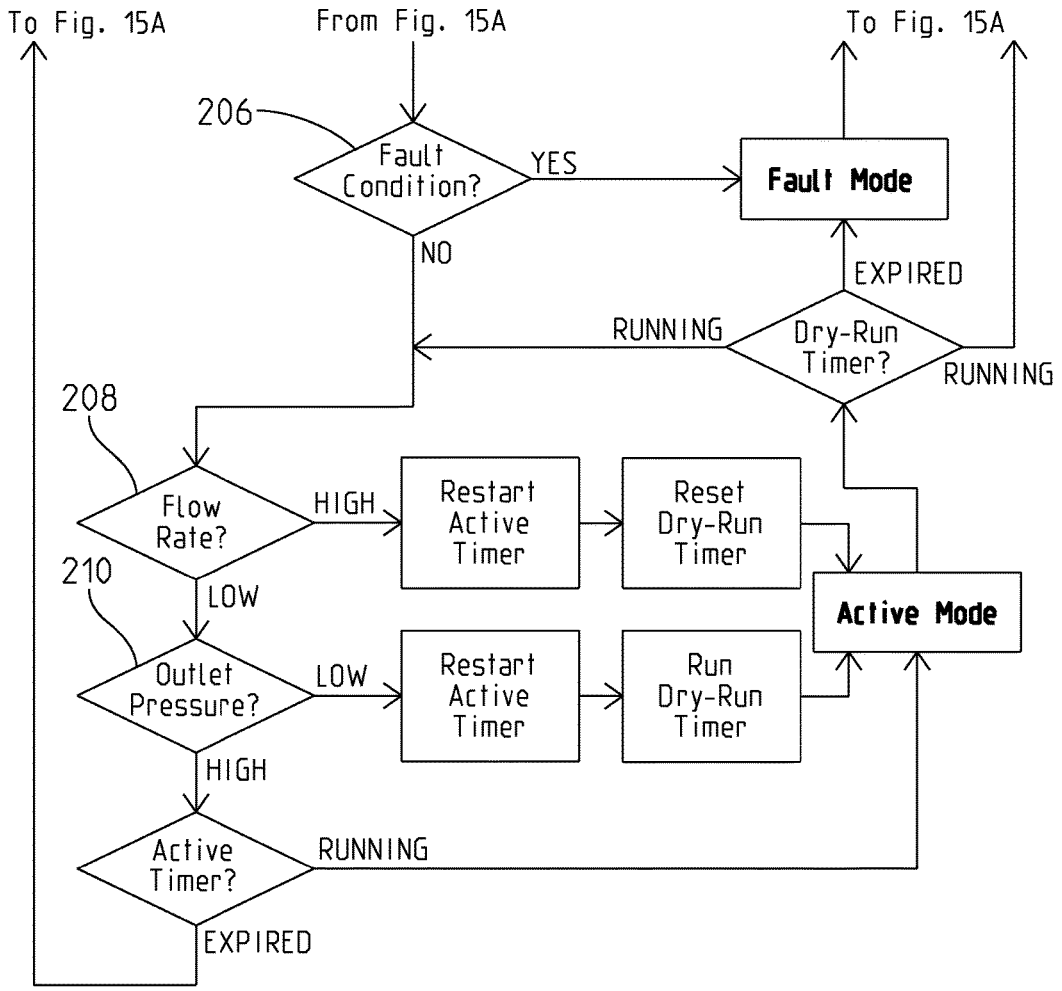

In the illustrated embodiment of FIGS. 15A and 15B, controller 80 operates PMA 30 in the active mode based on: (1) the inlet fluid pressure from step 204, and either (2a) the flow rate from step 208 or (2b) the outlet fluid pressure from step 210. More specifically, controller 80 operates PMA 30 in the active mode if: (1) the inlet fluid pressure from step 204 is too low, and either (2a) the flow rate from step 208 is sufficiently high or (2b) the outlet fluid pressure from step 210 is too low.

An active timer may be provided to maintain PMA 30 in the active mode for at least a minimum period of time (e.g., 15 seconds) to avoid quick starts and stops that could lead to unwanted pressure fluctuations. Each time controller 80 enters the active mode from step 208 or step 210, controller 80 may restart the active timer. In this embodiment, even if the flow rate from step 208 or the outlet fluid pressure from step 210 would otherwise return PMA 30 to the standby mode, controller 80 may continue operating PMA 30 in the active mode until the active timer expires. Eventually, when the active timer expires, controller 80 may return PMA 30 to the standby mode.

A dry-run timer may be provided to protect PMA 30 against dry-run (i.e., loss of prime or restricted flow) conditions over a certain period of time (e.g., 20 seconds), which could damage PMA 30. Each time controller 80 enters the active mode from step 210, which indicates a low flow and low outlet pressure condition, controller 80 may initiate or continue running the dry-run timer without restarting the dry-run timer. However, each time controller 80 enters the active mode from step 208, which indicates a high flow condition, controller 80 may reset and stop the dry-run timer. When the dry-run timer is running and before the dry-run timer expires, controller 80 may return to step 204 from the active mode. Eventually, when the dry-run timer expires, controller 80 may enter the fault mode.

The various timers, including the delay timer, the fault timer, the active timer, and the dry-run timer, may be reset and stopped when controller 80 returns to the off mode and/or the standby mode.

When pump unit 10 is installed in a fluid distribution system, an air tank (not shown) may be installed downstream of pump unit 10. In operation, the air tank may supply pressure to the fluid downstream of pump unit 10. In this arrangement, pump unit 10 may be provided to supply additional pressure to the fluid, as necessary. For example, pump unit 10 may supply pressure to the fluid downstream of pump unit 10 to recharge the distribution system when the air tank has been emptied. As another example, pump unit 10 may supply pressure to the fluid downstream of pump unit 10 when the fluid upstream of pump unit 10 is provided at low pressure.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pump unit configured to pressurize a fluid in a fluid delivery system, the pump unit comprising:

a tank that forms at least a portion of a fluid reservoir;

a fluid inlet into the fluid reservoir;

a fluid outlet from the fluid reservoir;

a submersible pump positioned in the tank and arranged in fluid communication with the fluid inlet and the fluid outlet; and a mounting bracket moveably coupled to the tank relative to the fluid inlet and the fluid outlet in a first configuration and adapted to be fixedly coupled to tank in a second configuration.

2. The pump unit of claim 1, wherein the mounting bracket is rotatably coupled to the tank in the first configuration.

3. The pump unit of claim 1, wherein the mounting bracket comprises:

a body configured to couple to a support structure;

a first arm that extends from the body toward the tank; and a second arm that extends from the body toward the tank.

4. The pump unit of claim 3, wherein:

when the body of the mounting bracket is coupled to a vertical support structure, a head of the pump unit rests atop the first arm of the mounting bracket; and when the body of the mounting bracket is coupled to a horizontal support structure, the tank of the pump unit rests atop the first and second arms of the mounting bracket.

5. The pump unit of claim 3, further comprising an auxiliary hook removably coupled to the mounting bracket to extend the second arm.

6. The pump unit of claim 5, wherein the auxiliary hook is removably coupleable to the mounting bracket in:

a first position to extend the second arm in a first direction; and a second position to extend the second arm in a second direction opposite the first direction.

7. The pump unit of claim 1, further comprising a cap with a user interface on an exposed surface of the cap, wherein the cap is rotatably coupled to the tank relative to the fluid inlet and the fluid outlet.

* * * * *